United States Patent [19]

Musser

[11] 4,005,801

[45] Feb. 1, 1977

[54] BAG STORING AND DISPENSING APPARATUS

[76] Inventor: Malcolm E. Musser, P.O. Box 386, Jackson Center, Ohio 45334

[22] Filed: Jan. 14, 1976

[21] Appl. No.: 648,891

[52] U.S. Cl. ..... 221/56; 221/63

[51] Int. Cl.[2] ..... B65H 1/08

[58] Field of Search ..... 221/59, 34, 47, 304, 221/63; 312/60, 61, 71, 50

[56] References Cited

UNITED STATES PATENTS

| | | | |
|---|---|---|---|
| 1,114,354 | 10/1914 | Hildebrand | 221/56 X |
| 2,045,678 | 6/1936 | Shafer | 221/47 X |
| 3,679,096 | 7/1972 | Musser | 221/56 |

*Primary Examiner*—Stanley H. Tollberg
*Attorney, Agent, or Firm*—Jacox & Meckstroth

[57] ABSTRACT

Apparatus for storing and dispensing paper bags, wherein the bags are stored in collapsed condition and are automatically opened upon successive removal of the bags from the apparatus. The apparatus includes a frame for slidably supporting a container having a bag storing chamber and a front opening, an opening bar at the front opening of the container engaging the folded bottom panel of the front-most bag, restraining means for engaging the opposite sides and top of the front-most bag and a resiliently biased pusher member for applying pressure to the rear of a stack of bags in the container and forcing them to the front opening.

17 Claims, 14 Drawing Figures

FIG. 9
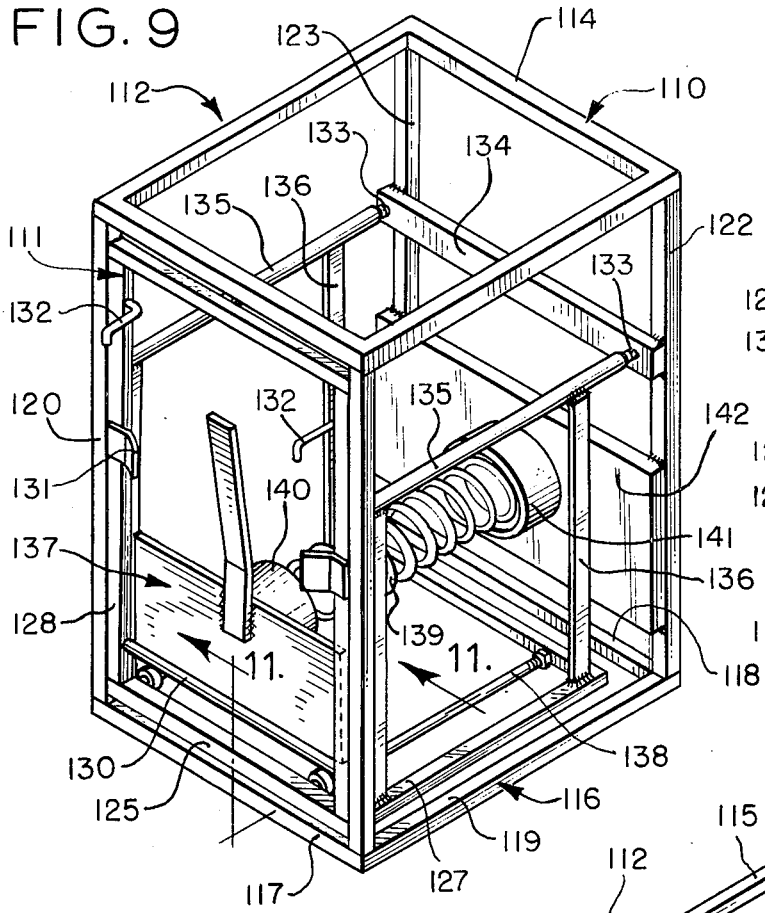
FIG. 12
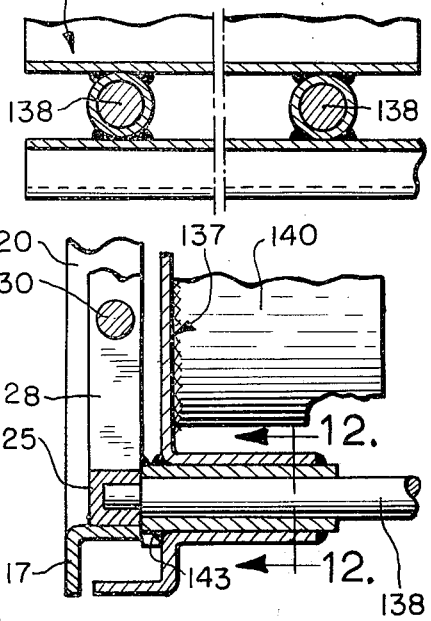
FIG. 11
FIG. 10
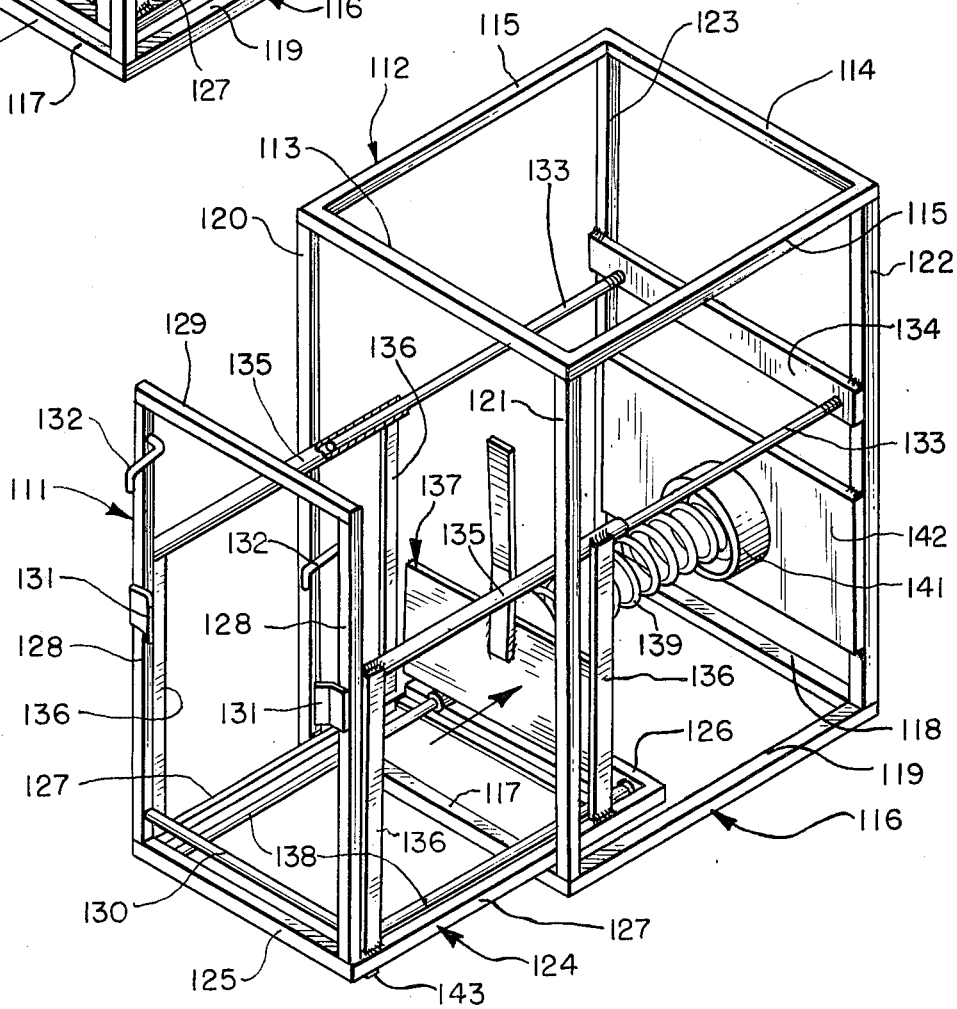

BAG STORING AND DISPENSING APPARATUS

This invention relates in general to a bag storing and opening apparatus, wherein bags may be successively dispensed and automatically opened, and more particularly to an apparatus especially useful for handling paper bags normally used for the bagging of retail goods.

Heretofore, there have been many bag storing and dispensing devices for handling collapsed paper bags which are opened during removal from the devices. It should be appreciated that paper bags are normally stored in flat collapsed condition and thereafter unfolded or opened when ready for use. Some of the prior known bag storing and opening devices have arranged the bags in a horizontal direction, as in U.S. Pat. No. 3,782,073, while others have arranged the bags in substantially vertical position, as in U.S. Pat. Nos. 2,673,134 and 3,679,096. The apparatus of the present invention arranges the bags in substantially vertical position like the latter two mentioned patents. Problems heretofore encountered in bag storing and dispensing devices include inconsistency in opening of bags during removal from the apparatus, difficulty in reloading the apparatus with a supply of folded bags, and complexity of construction which is costly.

The present invention overcomes the problems of heretofore known bag storing and opening devices in providing a relatively simply constructed unit which is extremely easy to load with folded bags and which produces the necessary consistency in opening of bags desired by retail establishments. The bag storing and dispensing apparatus of the invention may be used by itself on any counter or may be built into a counter or checkout stand.

The apparatus of the invention includes a frame, a container slidably mounted on the frame in the fashion of a drawer so that the container can be substantially removed from the frame for purposes of loading bags. The container is box-like in shape and includes a front opening through which the bags are dispensed. Restraining means is mounted at the sides and top of the front opening and a bag opening bar is mounted at the lower end of the front opening which extends transverse the opening. The bag opening bar is spaced inwardly of the restraining means so that the upper ends of the bags lean slightly forward to facilitate engagement thereof for removal. A pusher member is mounted in the container and resiliently biased to continually urge the bags forwardly to the opening and against the opening bar and restraining means. The bags are in a folded or collapsed form in the container and open automatically upon removal from the container by virtue of the opening bar engaging and holding the lower half of the bottom panel of the bag which is folded up against one of the sides until the bag is generally open. The pusher member and biasing means are constructed so that upon movement of the container to the position for loading of bags the biasing means automatically releases the pusher member and also allows the pusher to be in a retracted position in the container, thereby facilitating the loading of bags.

It is therefore an object of the present invention to provide a new and improved bag storing and dispensing apparatus which is simply constructed and which is capable of consistently providing bags in automatically open position upon removal from the apparatus.

Another object of this invention is in the provision of a new and improved bag storing and dispensing apparatus which may be quickly and easily loaded with a supply of bags, and which is easy to operate to automatically provide opened bags, thereby saving time of those bagging goods.

Other objects, features and advantages of the invention will be apparent from the following detailed disclosure, taken in conjunction with the accompanying sheets of drawings, wherein like reference numerals refer to like parts, in which.

Figure 8C:
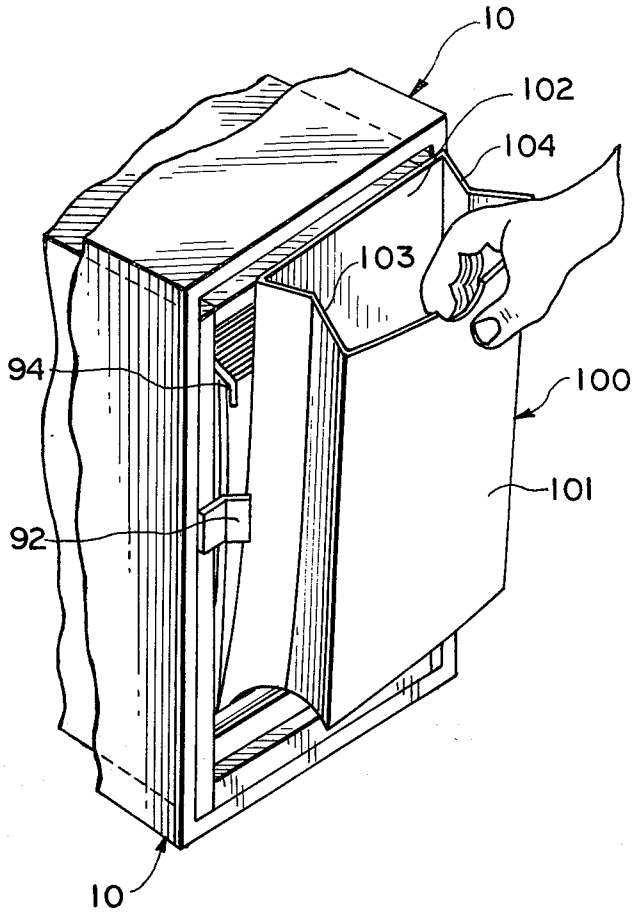
Figure 8B:
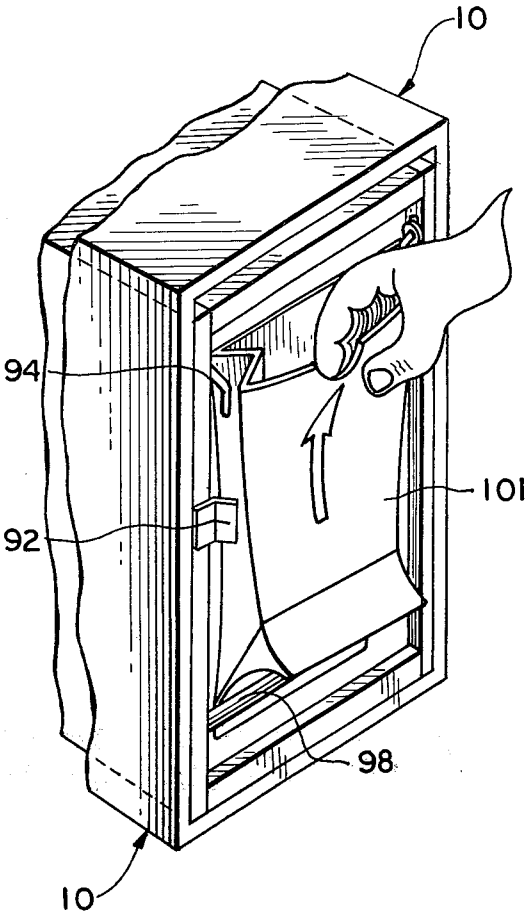
Figure 8A:
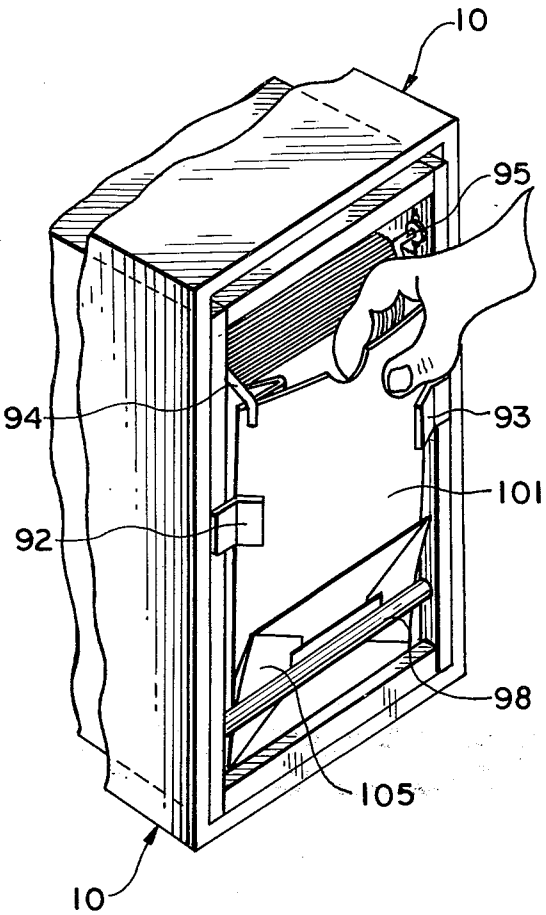

FIGS. 8*a*, 8*b* and 8*c* are fragmentary front perspective views of the apparatus of the invention and which illustrate in steps the manner of removing a folded bag and the manner in which the bag automatically opens upon being dispensed from the apparatus;

FIG. 9 is a perspective view of a modified bag storing and opening apparatus according to the invention with the container in closed position;

FIG. 10 is a perspective view of the embodiment in FIG. 9, illustrating the container in open bag loading position, but showing the pusher member positioned rearward of its normal rest position to show certain parts more clearly;

FIG. 11 is an enlarged detail sectional view taken substantially along line 11—11 of FIG. 9; and FIG. 12 is a sectional view taken substantially along line 12—12 of FIG. 11.

Figure 1:
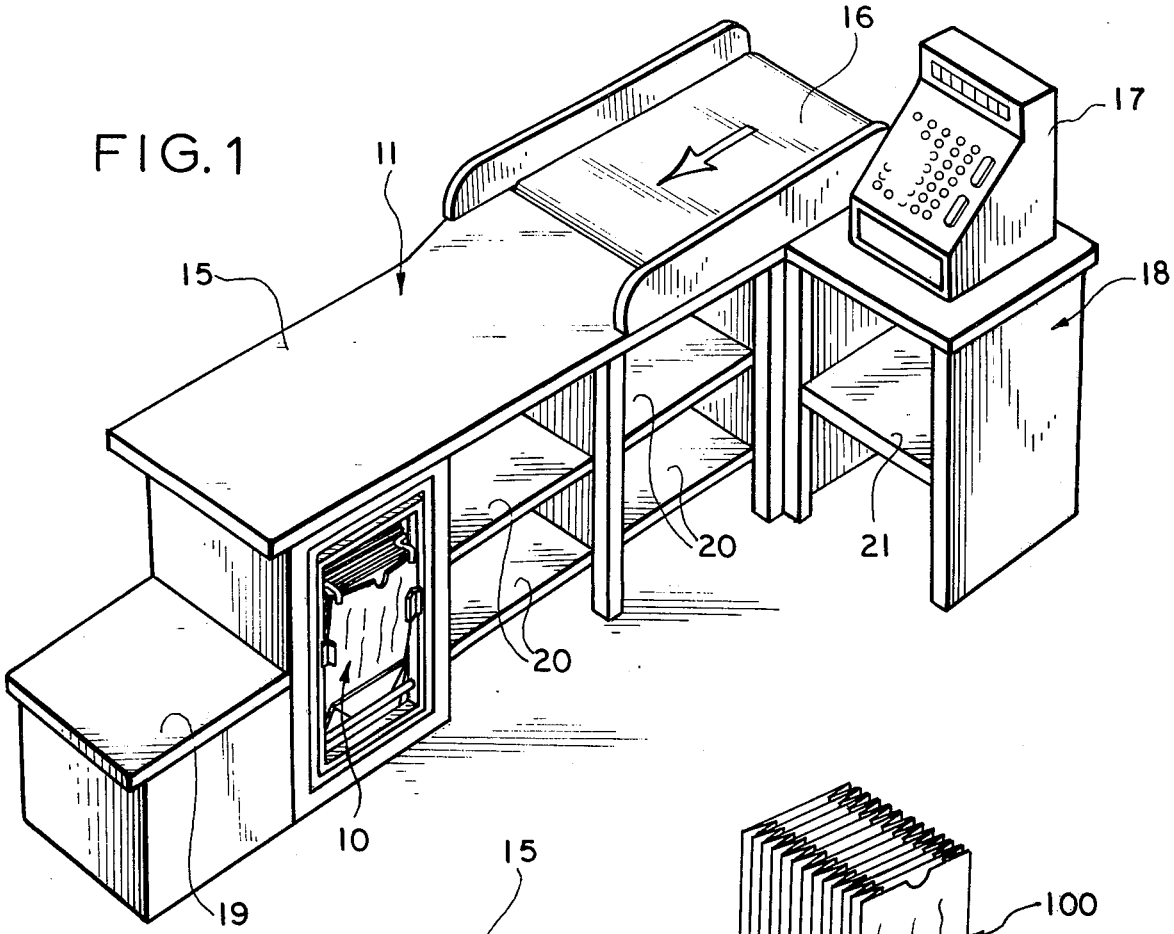
FIG. 1 is a perspective view of a checkout stand for a retail establishment, such as a supermarket, and which includes a bag storing and dispensing apparatus like the present invention built into the checkout stand.

Referring now to the drawings, and particularly to FIG. 1, the bag storing and dispensing apparatus embodiment of the present invention illustrated here, generally designated by the numeral 10, is illustrated as a built-in for a checkout stand 11. However, it will be appreciated the apparatus of the invention may be utilized in any suitable environment, and it need not be built into a checkout stand or the like.

The checkout stand 11 includes a generally waist-high counter 15 below which the apparatus of the invention is positioned. It can be appreciated that this checkout stand is especially useful for supermarkets although it may be used in any desired retail establishment. Goods are emptied onto a belt conveyor 16 which, upon being activated, delivers the goods to the waist-high counter 15. A checker standing adjacent to the conveyer and counter enters the price of the goods into a cash register 17 supported on a table 18 as they are deposited on the conveyer and then operates the conveyer to drive the goods to the bagging counter 15. In the event the checker is not able to bag the goods, the bagger standing at the bagging counter 15 would remove a sack from the apparatus 10 which would automatically open upon removal and place the sack onto an adjacent knee-high counter 19 so that the goods could be conveniently transferred from the waist-high counter 15 into the open bag. Additional storage space provided by shelves 20 below the counter 15 may be used for storage of bags or other items needed to carry on the functions at the checkout stand. Additionally, a shelf 21 is provided in the table 18 for storage. The checkout stand 11 is merely illustrated here to show one way in which the apparatus of the invention may be used.

Figure 2:
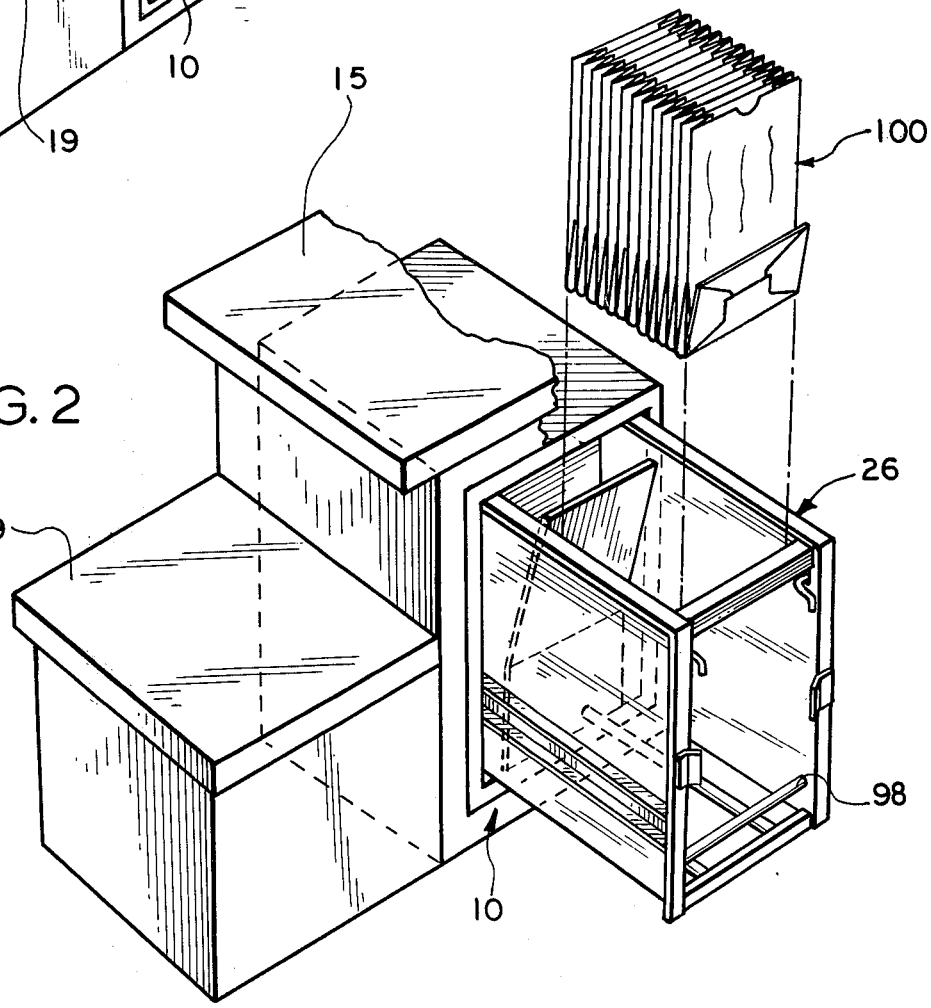
FIG. 2 is an enlarged fragmentary view of the checkout stand of FIG. 1 and showing the bag storing and opening apparatus of the present invention with the bag container in loading position to illustrate the manner in which folded bags are easily loaded into the apparatus.
Figure 5:
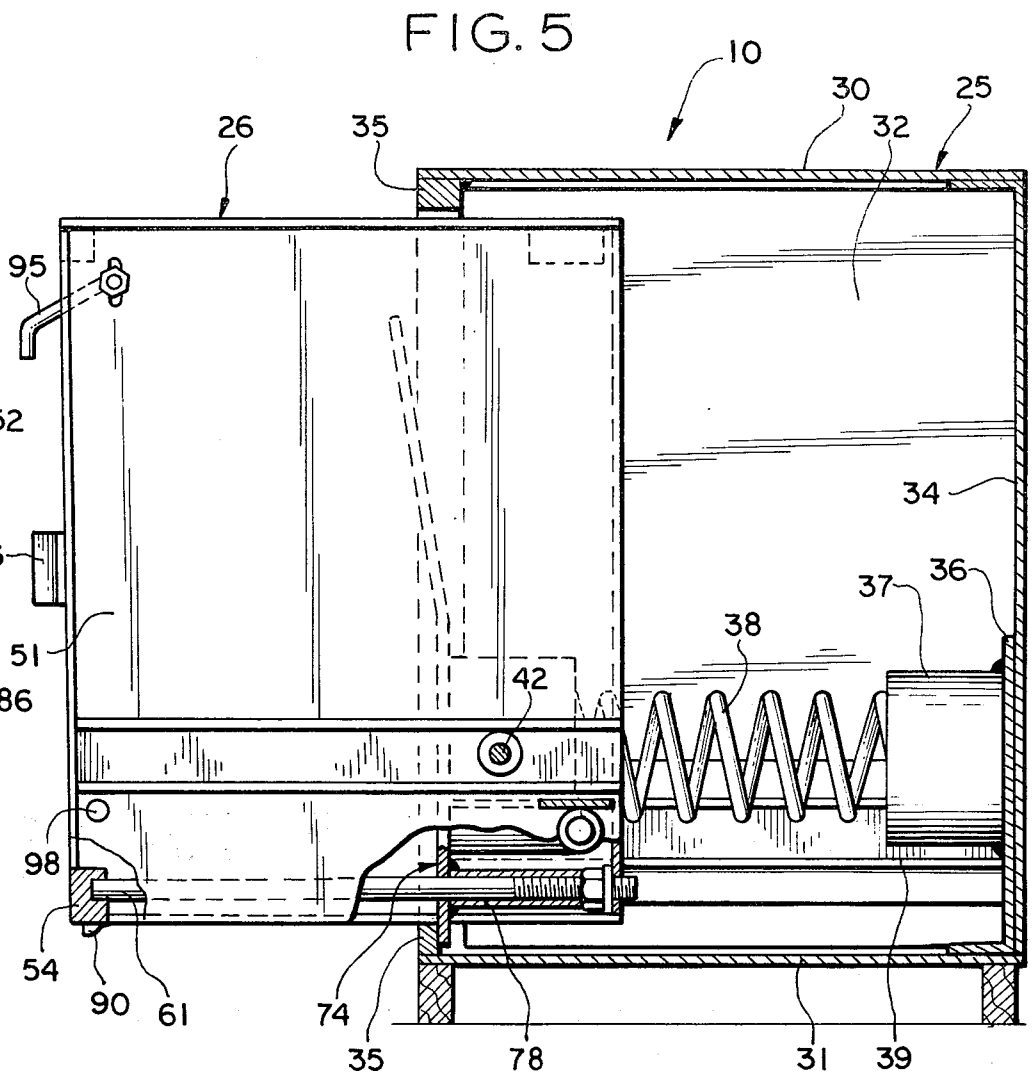
FIG. 5 is a vertical sectional view taken through the apparatus of the invention with the container moved to the position where loading of bags may be accomplished and showing some parts broken away to show underlying parts.
Figure 6:
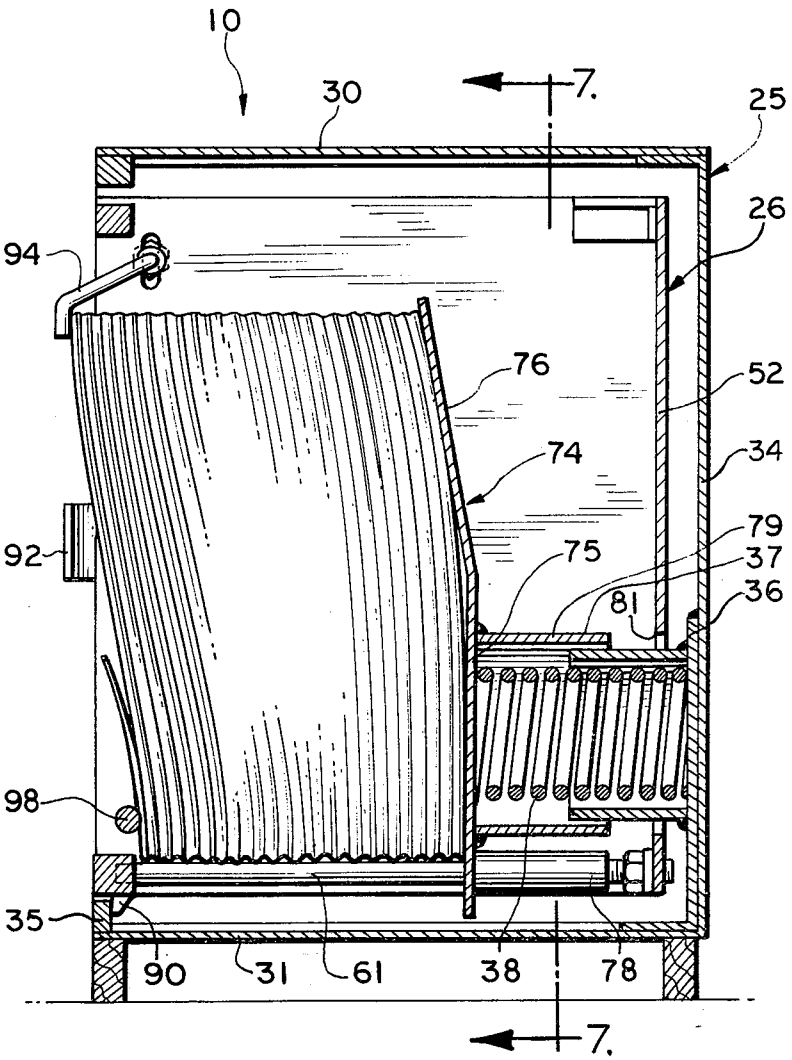
FIG. 6 is a vertical sectional view similar to FIG. 5 but showing the container in closed position and a stack of bags in the container ready to be dispensed.

The bag storing and dispensing apparatus embodiment 10 of the invention includes generally a frame 25 and a container 26 which is slidably mounted in the frame in the fashion of a drawer, which may be moved to an open position for loading bags, as seen in FIGS. 2 and 5, and to a closed position for dispensing and opening bags, as seen in FIG. 6. Accordingly, the container may be in a bag dispensing position or a bag loading position.

The frame 25 is a rectangular box-like structure including top and bottom opposed walls 30 and 31, upstanding opposed side walls 32 and 33, an upstanding rear wall 34, an opening defined opposite the rear wall 34, and a rectangular reenforcing rim 35 at the open front side. A mounting plate 36 having a tubular sleeve 37 attached thereto defines a socket for a coil spring 38. Channel-shaped tracks 39 and 40 and rotatably mounted rollers 41 and 42 are mounted on the opposed side walls 32 and 33 respectively for slidably mounting the container 26 in a manner that will be more clearly hereinafter explained. The tracks are horizontally extending in opposed alignment adjacent the lower ends of the side walls. Similarly, the rollers 41 and 42 are in opposed alignment just above the tracks 39 and 40 and positioned closely adjacent to the front opening of the frame. While the top, bottom, rear and side walls are closed, it should be appreciated they could be of an open framework type so long as the frame 25 can act as a supporting structure for the container 26.

Figure 3:
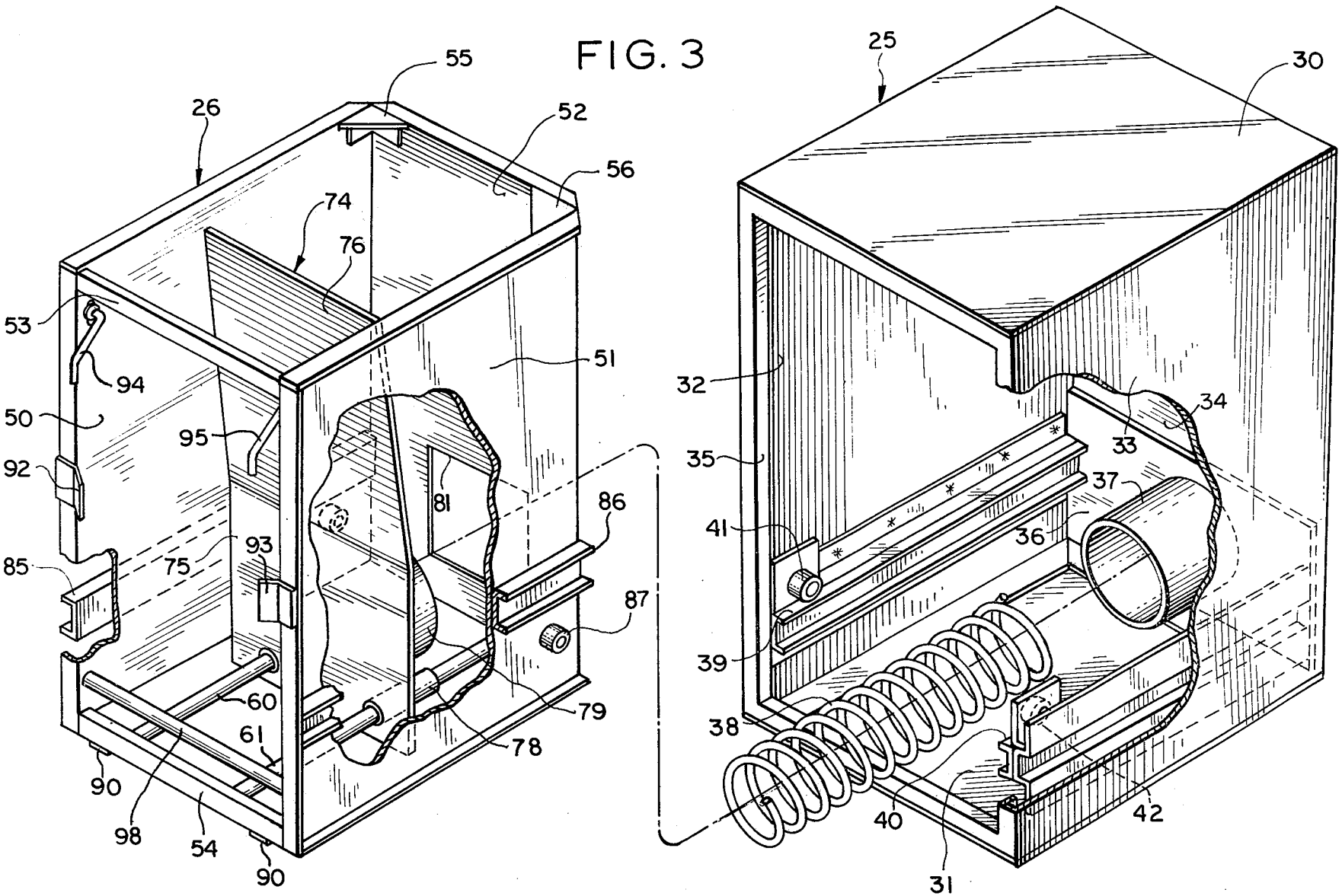
FIG. 3 is a greatly enlarged exploded perspective view of the apparatus of the present invention with some parts cut away for purposes of showing underlying parts and to facilitate understanding the invention.

The container 26 includes opposed upstanding side walls 50 and 51, an upstanding back wall 52 and upper and lower crossbars 53 and 54 at the forward ends of the side walls. Further, to strengthen the side walls and the back wall, the upper and lower edges of these walls, as well as the forward ends of the side walls, are flanged. Further, corner braces 55 and 56 are provided between the side walls and the back wall at the upper ends, as seen in FIG. 3, to further rigidify the structure. The upper, lower and forward ends of the container 26 are open. Accordingly, a front is provided in the container through which bags may be dispensed, while the opening in the upper side of the container permits loading therethrough of a supply of folded bags when the container is in the bag loading position, such as shown in FIGS. 2 and 5.

Figure 4:
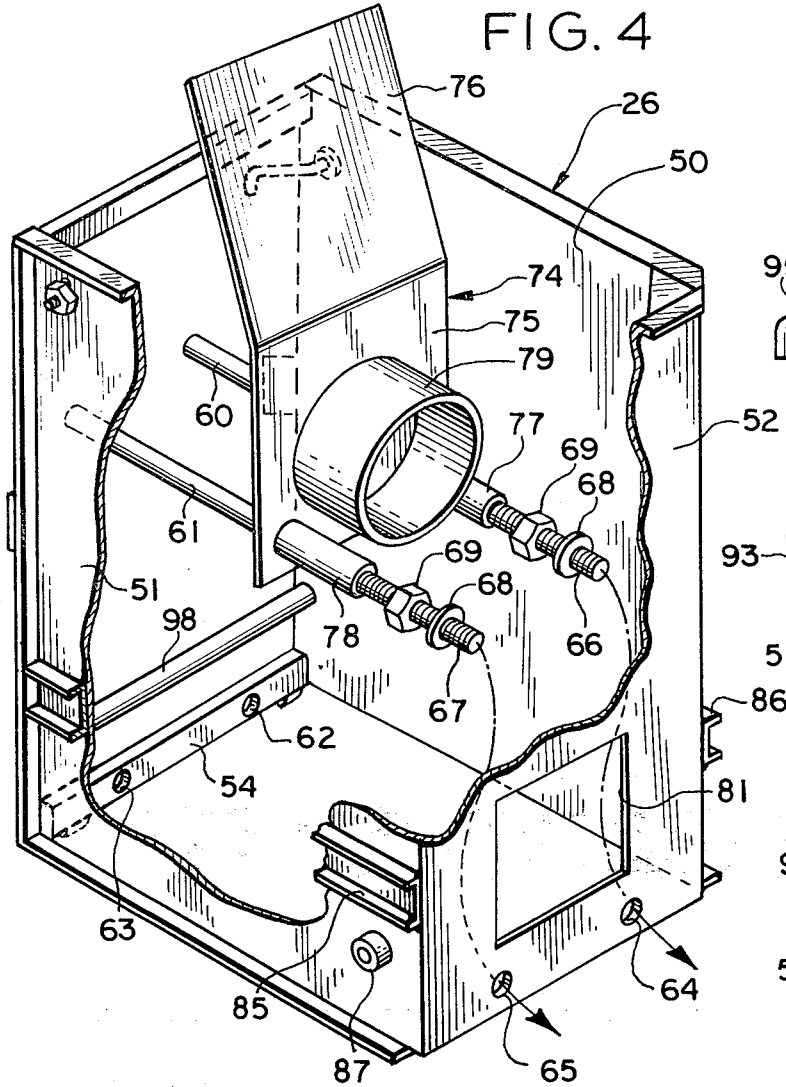
FIG. 4 is a rear perspective view of the bag container portion of the apparatus as removed from the frame with some parts in section to show underlying parts and other parts in exploded position to illustrate the manner of assembly.

The paper bags, when arranged in stock form within the container, are supported in vertical position by resting on a pair of horizontally extending parallel spaced guide rods 61 and 62. These guide rods extend from front to back in the container and at the lower end thereof and are supported at their forward ends in sockets 62 and 63 formed in the rear face of the lower crossbar 54. The guide rods are supported at their rear ends in holes 64 and 65 formed in the back wall 52, as seen in FIG. 4. The rear ends of the rods are threaded at 66 and 67 to receive lock washers 68 and nuts 69, which, when properly tightened along threaded portions, lock the guide rods in position, as seen in FIG. 5.

Supported within the container and slidably along the guide rods 60 and 61 is a pusher member 74 which functions to coact with the coil spring 38 and continually urge the bags forward toward the front opening of the container when the container is in dispensing position, as seen in FIG. 6. The pusher member includes an upstanding plate having a lower substantially vertical section 75 and an upper somewhat forwardly inclined section 76, the latter of which urges the upper portions of the bags forwardly ahead of the lower portions, as seen in FIG. 6, to facilitate gripping of a bag in the dispensing and bag opening operation. Guide sleeves 77 and 78 are mounted at the lower end of the lower vertical portions 75 of the pusher member and which freely receive and move on the guide rods 60 and 61. A tubular sleeve 79 is mounted on the rear side of the lower vertical portion 75 to define with the vertical portion a socket in which the forward end of the coil spring 38 is guidably received. Accordingly, the pusher member 74 is guidably movable within the container along the guide rods 60 and 61, as illustrated in FIG. 6. Further as seen in FIG. 6, the tubular member 79 is larger than the tubular member 37 so that when the pusher member 74 is in the rear-most position, as seen in FIG. 6, the tubular sleeves will not interfere with one another. Moreover, as seen in FIG. 6, an opening 81 is provided in the rear wall 52 of the container through which the tubular sleeve 37 may project when the container is in the dispensing position.

Figure 7:
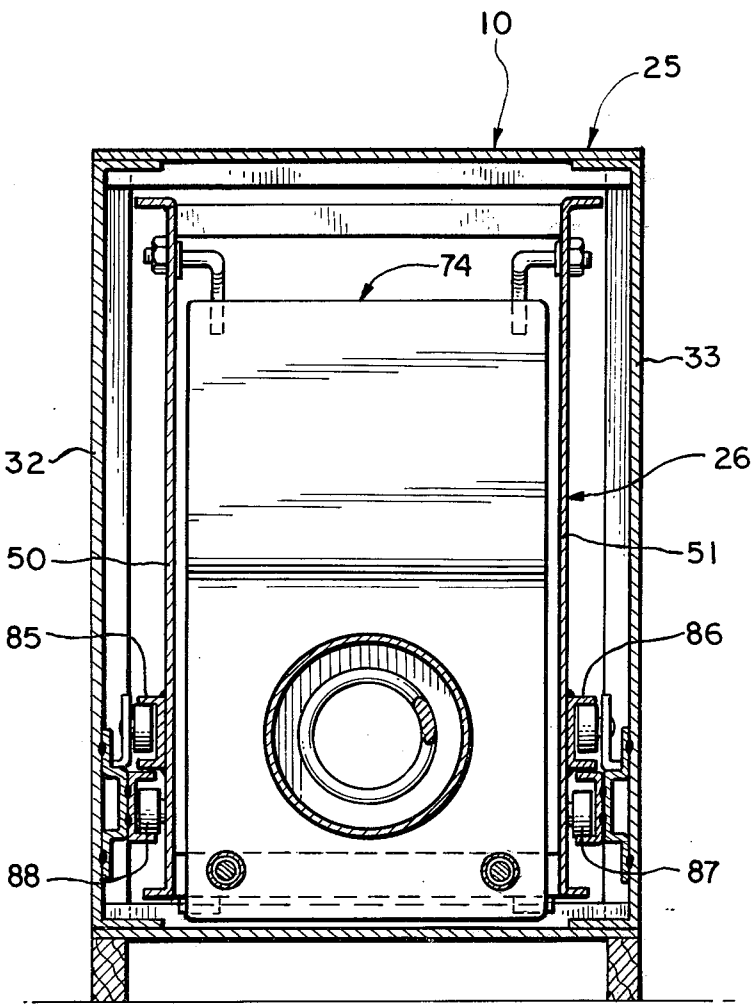
FIG. 7 is a vertical sectional view taken substantially along line 7—7 of FIG. 6.

Channel-shaped tracks 85 and 86 and rotatably mounted rollers 87 and 88 are provided on the opposite side walls 50 and 51 of the container 26 to respectively coact with the rollers 41 and 42 and the tracks 39 and 40 that are mounted on the frame 25, as can be seen in FIGS. 5 and 7. Accordingly, the track and roller assemblies mount the container for drawer-like movement relative to the frame which is necessary for the loading of the container with a supply of folded paper bags. As seen in FIG. 5, the lower end of the pusher member 74 coacts with the rim 35 of the frame 25 when the pusher member is in its full rearward position within the container to prevent the container from being pulled completely free of the frame. Accordingly, the outward position of the container relative to the frame is limited by the pusher and the rim. Further, the rim coacts with a pair of lugs 90, as seen in FIG. 6, to retain the container in the closed or bag dispensing position when the spring 38 has been energized to apply a force against the pusher member 74. The clearance formed between the upper end of the container 26 and the frame 25, as seen in FIG. 6, allows the necessary up-and-down movement of the container to permit the lugs to clear the rim 35 during movement of the container between bag loading and bag dispensing positions.

Restraining members are provided at the front opening of the container for holding the front-most bag in the container but also allowing the front-most bag to be removed and thereafter functioning to assist in opening up the bag by retaining the back wall of the bag as the bag is moved upwardly and outwardly of the container. These restraining members include a pair of tabs 92 and 93 mounted in opposed relation along the flanged forward vertical edges of the container side walls 50 and 51 and about midway between the top and bottom edges of these walls. The tabs are inclined outwardly from the flanged ends of the side walls to allow the upper portions of the bags to be moved outwardly of the lower portions, as seen in FIG. 6. Additionally, restraining members in the form of a pair of fingers 94 and 95 are mounted at the upper end of the front opening of the container to engage over the upper ends of the bags. These fingers are secured to the side walls 50 and 51 of the container in slots to not only allow some vertical movement for adjustment of position and also to allow some rotational movement so that the fingers can be properly positioned to give the proper restraining action at the upper corners of the bags. Accordingly, the upper portions of the bags are restrained by tabs 92 and 93 and fingers 94 and 95.

Outward movement of the lower portions of the bags is prevented by a transversely extending cylindrical in cross section opening bar 98 arranged adjacent the lower end of the front opening of the container and extending horizontally to engage the lower half of the folded bottom panel of the bags, as seen in FIG. 6. The bag opening bar 98 is supported at opposite ends in suitable sockets formed in the opposed side walls 50 and 51 of the container. The bar may be rotatably mounted or fixed against rotation. Further, it may be noted that the bar is spaced inwardly from the restraining members 92 to 95, as seen particularly in FIGS. 5 and 6, whereby the lower portions of the bag are behind the upper portions and whereby a much greater frictional force is generated between the opening bar and the bags than between the restraining members and the bags.

The manner of removing and opening a paper bag is illustrated in FIGS. 8*a*, 8*b* and 8*c*, and for purposes of understanding this operation and the overall operation of the apparatus in the invention, it may be appreciated that each paper bag, generally designated by the numeral 100, includes a front wall or panel 101, a back wall or panel 102, opposed side walls or panels 103 and 104, and a bottom wall or panel 105. The paper bags may be of any size but normally of a size for a supermarket for holding groceries. The side panels 103 and 104 are folded inwardly and the bottom panel 105 is folded upwardly against the front panel 101 in a conventional fashion, as seen in FIGS. 6 and 8*a*. Placement of the bags in the container will be as shown in the drawings wherein the bottom wall 105 of the bags is forward and will engage the opening bar 98. The positioning of the opening bar, as above stated, is such as to engage the lower half of the bottom wall of the front-most bag where a necessary restraining force is applied to the bag during an opening operation.

The loading operation of the apparatus of the invention is very simple in that it merely requires the operator to apply a slight lifting force to the crossbar 53 of the container 26 until the lugs 90 are free of the rim 35 and then apply an outward force on the container to bring it to the load position shown in FIGS. 2 and 5 when the container is pulled as far as it can go as dictated by the stop action effected between the pusher member 74 and the rim 35. It will be noted that the force of the spring 38 is released and the pusher member 74 is automatically positioned in a retracted position relative the container 26, leaving the upper open and of the container free and into which a stack of collapsed bags may be easily inserted until they rest on the guide rods 60 and 61. Thereafter, the container is pushed back into the frame 25 until the lugs catch on the rim 35 and which will automatically bring the pusher member 74 into operation as the spring 38 will be automatically energized to push the bags toward the front opening of the container, as seen in FIG. 6.

The dispensing operation of the bags and the opening of the bags is illustrated in FIGS. 8*a*, 8*b* and 8*c*. The operator will grasp the exposed front wall 101 of the front-most bag, pull it outwardly slightly to free the front wall from the restraining members 92, 93, 94 and 95, as seen in FIG. 8*b*. Thereafter, the operator pulls upwardly and outwardly on the front wall wherein the restraining means holds the rear wall 102 to allow the front wall to move away from the rear wall. Further, inasmuch as the opening bar 98 is applying a frictional force against the lower end of the bottom wall 105, the upward force applied to the front wall 101 unfolds the bottom wall to an open position and thereafter further upward and outward movement of the bag ultimately releases the bottom wall and opposing rear wall from the grip between the next-most bag and the opening bar to free the bag in opened position. Accordingly, successive dispensing of the bags from the container will automatically open the bags for immediate use by the operator and bagging operations can immediately be effected. This eliminates a time-consuming job of the bagger to manually open the bags for the bagging operations.

Another form of the invention is illustrated in the embodiment shown in FIGS. 9 to 12 and where the bag opening device is generally designated by the numeral 11A. This embodiment differs primarily in that the container is supported relative the frame in a different manner. The frame is generally designated by the numeral 110, while the container is generally designated by the numeral 111, and as can readily be seen, both the frame and the container are formed of a combination of bars and braces interconnected together.

The frame includes an upper rectangular support 112 having front and back bars 113 and 114 and opposed side bars 115. A lower rectangular support 116 is in opposed relation to the upper support and includes front and back bars 117 and 118 and opposed side bars 119. The upper and lower supports are interconnected by upstanding corner posts 120, 121, 122 and 123.

The container 111 includes a lower rectangular support 124 sized to move between the upper front corner posts 120 and 121 of the frame and including front and back bars 125 and 126 and opposed side bars 127. Upstanding from the front bar 125 are opposed side bars 128 which are connected together at their upper ends by a top bar 129, all of which coact with the lower bar 125 to define the front opening of the container. Mounted near the lower bar 125 and in parallel to it and between the opposed upstanding bars 128 is the opening bar 130 which functions identical to the opening bar 98 of the first embodiment. Also mounted along the opposed side bars 128 are opposed tabs 131 and opposed fingers 132, which function as the restraining means for the bags at the upper portions of the bags in the same manner as the tabs 92 and 93 and the fingers 94 and 95 of the first embodiment.

The container 111 is supported relative the frame 112 by the engagement of the lower rectangular support 124 along the frame bar 117 together with cantileverly supported rods 133 extending from a cross brace 134 on the frame which telescopically receive tubular guides 135 connected to the container. The guides extend rearward from the upstanding side bars 128 of the container and are further supported in relation to the lower rectangular support 124 by means of a plurality of upstanding reenforcing bars 136.

Like the first embodiment, the pusher member 137 is slidably supported along the guide rods 138 carried by the container and specifically mounted between the front and rear bars 125 and 126 of the lower rectangular support 124. A pusher spring 139 is supported between a socket 140 secured to the backside of the pusher member 137 and a socket 141 secured to a cross plate 142 that is connected to the rear upstanding corner posts 122 and 123 of the frame. Stops 143 are provided on the container for coacting with the front bar 117 of the lower rectangular support 116 of the frame to hold the container in position when it is loaded and maintain the pusher member in energized relation relative the bags. It will be understood that the bag opener 11*a* operates essentially the same as the bag opener 11 of the first embodiment, and it can be appreciated that the structure differs mainly in the manner in which the container is supported relative the frame.

From the foregoing, it can be appreciated the apparatus of the present invention not only enables the automatic dispensing of opened bags but also provides for ease in quickly loading the apparatus with a supply of folded bags.

It will be understood that modifications and variations may be effected without departing from the scope of the novel concepts of the present invention, but it is understood that this application is to be limited only by the scope of the appended claims.

The invention is hereby claimed as follows:

1. Apparatus for storing and successively dispensing paper bags in opened condition, wherein each bag includes opposite side walls and opposite end walls connected by a bottom wall and being foldable between an open condition and a collapsed condition with the end walls folded between the side walls and the bottom wall folded against one of the side walls, said apparatus comprising a box-like structure defining a bag storing chamber and having a rectangular front opening and means for supporting a stack of substantially vertically arranged collapsed bags in said chamber with the upper end portion of said one side wall of the front-most bag in the stack exposed for manual gripping, restraining means adjacent the front opening for normally restraining the stack of bags in the chamber and for restraining the other side wall of the front-most bag when said one side wall is pulled from said restraining means, a transversely extending opening bar across the front opening and near the bottom thereof against which the entire lower half of the bottom wall of the bag engages, said opening bar being positioned below the restraining means and spaced inward of the restraining means such that the upper portion of the bags extends forward through the opening, a pusher member supported within said structure and engaging the back of the stack of bags, and means resiliently biasing said pusher member toward the front opening to continually maintain the front-most bag against the opening bar and the restraining means, whereby pulling upward on the one side wall of the bag causes unfolding of the bottom wall and opening of the bag as the bag is removed from the stack.

2. Apparatus as defined in claim 1, wherein the pusher member is guidably supported along a pair of parallel guide rods mounted at the lower end of the cabinet, and said guide rods also supporting the lower edges of the bags.

3. Apparatus as defined in claim 2, wherein said guide rods are removable from the cabinet in disassembly of the apparatus.

4. Apparatus as defined in claim 1, wherein said restraining means includes a pair of fingers at the top of the opening.

5. Apparatus as defined in claim 1, wherein said pusher member may be released to facilitate loading of bags.

6. Apparatus for storing and successively dispensing paper bags in opened condition, wherein each bag includes opposite side walls and opposite end walls connected by a bottom wall and being foldable between an open condition ad a collapsed condition with the end walls folded between the side walls and the bottom wall folded against one of the side walls, said apparatus comprising a frame, a box-like container having a front opening and defining a bag chamber for storing a stack of substantially vertically arranged collapsed bags, means for slidably supporting said container on said frame such that the container may be moved between bag loading and dispensing positions, means adjacent the front opening for normally restraining the stack of bags in the chamber and for restraining the other sde wall of the front-most bag when said one side wall is pulled from said restraining means, a transversely extending opening bar across the front opening and near the bottom thereof against which the entire lower half of the bottom wall of the bag engages, said bar being spaced inward of the restraining means such that the upper portion of bags extends forward through the opening, a pusher member supported within said container and engaging the back of the stack of bags, and means resiliently biasing said pusher member towards the front opening to continually maintain the front-most bag against the opening bar and the restraining means, whereby pulling upward on the one side wall causes unfolding of the bottom wall and opening of the bag as the bag is removed from the stack, said biasing means being bottomed at one end on said frame so that the biasing action is automatically released from the pusher member when the container is moved to the bag loading position for loading bags and automatically applied to the pusher member when the container is returned to the dispensing position.

7. Apparatus as defined in claim 6, wherein said means for slidably supporting said container on said frame includes a plurality of track and roller assemblies.

8. Apparatus as defined in claim 6, wherein said means for slidably supporting said container on said frame includes cantileverly supported rods extending from said frame and telescopically receiving tubular members carried by said container.

9. Apparatus as defined in claim 6, wherein said restraining means includes a tab at each side of the opening and a pair of fingers at the top of the opening.

10. Apparatus as defined in claim 6, wherein said opening bar is cylindrical.

11. Apparatus as defined in claim 10, wherein said bar is rotatably mounted.

12. Apparatus as defined in claim 6, wherein said pusher member has a forwardly extending portion at the upper end thereof to push the upper ends of the bags ahead of the lower ends thereof.

13. Apparatus as defined in claim 6, wherein said biasing means includes a coil spring.

14. Apparatus as defined in claim 6, wherein means is provided to prevent the pusher member from moving with the container when the container is in bag loading position thereby maintaining the pusher member in retracted position relative the container to permit loading of bags.

15. Apparatus as defined in claim 6, wherein said pusher member is guidably supported along a pair of parallel guide rods mounted at the lower end of the container, and said guide rods also supporting the lower edges of the bags.

16. Apparatus as defined in claim 13, wherein guide members are provided on the frame and the pusher member for maintaining the spring in alignment therewith.

17. Apparatus as defined in claim 14, wherein said frame and container includes means for retaining the container in dispensing position.

* * * * *

UNITED STATES PATENT OFFICE

CERTIFICATE OF CORRECTION

PATENT NO. : 4,005,801

DATED : February 1, 1977

INVENTOR(S) : Malcolm E. Musser

It is certified that error appears in the above-identified patent and that said Letters Patent are hereby corrected as shown below:

Column 3, line 10, change "the", first occurrence, to ---a---.

Column 6, line 7, change "and" first occurrence to -- end --.

Column 8, line 25, change "ad" to ---and---.

Column 8, line 36, change "sde" to ---side---.

Signed and Sealed this

Twelfth Day of April 1977

[SEAL]

*Attest:*

RUTH C. MASON
*Attesting Officer*

C. MARSHALL DANN
*Commissioner of Patents and Trademarks*